US009016773B2

(12) United States Patent
Tanner et al.

(10) Patent No.: US 9,016,773 B2
(45) Date of Patent: Apr. 28, 2015

(54) HINGE MECHANISM FOR A VEHICLE HOOD

(71) Applicant: E.R. Wagner Manufacturing Co., Milwaukee, WI (US)

(72) Inventors: Ryan Tanner, Milwaukee, WI (US); Daniel Danoski, Milwaukee, WI (US); Bradley Gador, Milwaukee, WI (US)

(73) Assignee: E.R. Wagner Manufacturing Co., Milwaukee, WI (US)

( * ) Notice: Subject to any disclaimer, the term of this patent is extended or adjusted under 35 U.S.C. 154(b) by 100 days.

(21) Appl. No.: 13/755,281

(22) Filed: Jan. 31, 2013

(65) Prior Publication Data

US 2014/0183907 A1 Jul. 3, 2014

Related U.S. Application Data

(60) Provisional application No. 61/747,665, filed on Dec. 31, 2012, provisional application No. 61/749,114, filed on Jan. 4, 2013.

(51) Int. Cl.
*E05D 11/10* (2006.01)
*E05F 1/12* (2006.01)

(52) U.S. Cl.
CPC ..... *E05D 11/10* (2013.01); *E05F 1/1215* (2013.01); *E05Y 2201/224* (2013.01); *E05Y 2201/244* (2013.01); *E05Y 2900/536* (2013.01); *E05Y 2900/516* (2013.01)

(58) Field of Classification Search
USPC ..... 296/146.11, 76, 193.11; 180/69.21; 16/295, 296
See application file for complete search history.

(56) References Cited

U.S. PATENT DOCUMENTS

| | | | |
|---|---|---|---|
| 2,547,550 | A | 4/1951 | Whitmore |
| 2,703,430 | A | 3/1955 | Thomas et al. |
| 3,469,277 | A | 9/1969 | Henrich et al. |

(Continued)

FOREIGN PATENT DOCUMENTS

| | | | |
|---|---|---|---|
| WO | WO92/22722 | A2 | 12/1992 |
| WO | WO2008/048887 | A2 | 4/2008 |

OTHER PUBLICATIONS

Drawing—Hood Pivot Assembly (L48-6094), dated Feb. 24, 2011.

*Primary Examiner* — Joseph D Pape
(74) *Attorney, Agent, or Firm* — Faegre Baker Daniels LLP

(57) ABSTRACT

A hinge including a first hinge half rotatably connected to a second hinge half is described. A support mechanism selectively supports the first hinge half at one or more rotated positions relative to the second hinge half. The support mechanism includes a support which is selectively biased toward a support position in which the support is capable of supporting the first hinge half at a rotated position relative to the second hinge half. The support can further be selectively biased into a disengaged position in which the support is not capable of supporting the first hinge half relative to the second hinge half. With the support in a disengaged position, the first hinge half is freely pivotable relative to the second hinge half. An automatic reset mechanism may be utilized in connection with the hinge to reposition the support from the disengaged position to the support position as the hinge approaches a predefined position.

24 Claims, 9 Drawing Sheets

(56) References Cited

U.S. PATENT DOCUMENTS

| | | | | |
|---|---|---|---|---|
| 4,097,958 | A | 7/1978 | Van Dell | |
| 5,235,725 | A | 8/1993 | Rees | |
| 7,147,191 | B2 | 12/2006 | Ichikawa et al. | |
| 7,350,845 | B1 * | 4/2008 | Duffy | 296/76 |
| 7,536,748 | B2 | 5/2009 | Renke et al. | |
| 7,540,345 | B2 | 6/2009 | Bigsby et al. | |
| 7,546,663 | B2 | 6/2009 | Duffy | |
| 7,926,603 | B2 * | 4/2011 | Bonsen | 180/69.21 |

* cited by examiner

HINGE MECHANISM FOR A VEHICLE HOOD

BACKGROUND

1. Field of the Disclosure

The present disclosure relates to a hinge and, more particularly, to a hinge including an automatic support feature useable, e.g., to support a hood above the engine compartment of a motor vehicle.

2. Description of Related Art

Hinges are used to join two components so that they may selectively pivot relative to each other. For example, motor vehicles such as tractor trailers employ hinges to rotatably connect the hood of the vehicle to the engine compartment so that the hood may be selectively pivoted from a closed position in which the hood covers the engine compartment to an open position allowing access to the engine compartment. Often, it is desirable to hold a hood open so that a person can perform routine maintenance or examine the engine within the engine compartment.

SUMMARY

The present disclosure relates to a hinge including a first hinge half rotatably connected to a second hinge half. A support mechanism in accordance with the present disclosure selectively supports the first hinge half at one or more rotated positions relative to the second hinge half. The support mechanism of the present disclosure includes a support which is selectively biased toward a support position in which the support is capable of supporting the first hinge half at a rotated position relative to the second hinge half. The support can further be selectively biased into a disengaged position in which the support is not capable of supporting the first hinge half relative to the second hinge half. With the support in the disengaged position, the first hinge half is freely pivotable relative to the second hinge half. When utilized in connection with the hood of a motor vehicle, the support can be positioned in a disengaged position to allow closure of the hood relative to the engine compartment.

In one exemplary embodiment, the support includes a pawl and the first hinge half includes a plurality of ratchet teeth sized and shaped to cooperate with the pawl to support the first hinge half at a rotated position relative to the second hinge half. When used in connection with the hood of a motor vehicle, the support of this exemplary embodiment is, in the support position, resiliently biased so that the pawl rides along the ratchet teeth of the first hinge half as the hood is moved from a closed position in which the hood closes the engine compartment to an open position in which the hood allows access to the engine compartment. As each ratchet tooth passes the pawl, the pawl cooperates with the ratchet tooth in question to provide a physical barrier to closure of the hood. When it is desired to move the hood from an open position supported by the ratchet and pawl combination, the support (and, consequently, the pawl) can be moved against the biasing force urging the support into the support position to place the support in the disengaged position. In the disengaged positioned, a biasing force urges the support to maintain the disengaged position to allow closure of the hood.

In alternative forms of the present disclosure, an automatic reset mechanism or reset means is provided. The automatic reset mechanism of the present disclosure repositions the support from the disengaged position to the support position as the hinge approaches a predefined position. In one embodiment, the predefined position corresponds to a relatively more closed position (i.e., a position in which the two hinge halves are relatively close to one another) and the reset mechanism is actuated as the hinge is moved toward the closed position. For example, if the hinge of the present disclosure is employed as a hood hinge, then the automatic reset mechanism will act to reposition the support from the disengaged position to the support position as the hinge approaches a closed position in which the hood closes the engine compartment. In one exemplary embodiment, the automatic reset mechanism will actuate the support from the disengaged position to the support position as the hinge approaches a rotational position approximately 10° from the closed position, e.g., when the hood is 10° from its closed position.

In one form thereof, the present disclosure provides a hinge mechanism including a hinge comprising a first hinge half and a second hinge half rotatably connected to the first hinge half, so that the first hinge half is rotatable about a hinge axis relative to the second hinge half. The hinge mechanism of this form of the present disclosure further includes a support mechanism including a support moveable from a support position in which the support is capable of supporting the first hinge half at a first rotated position relative to the second hinge half and a disengaged position in which the support is not capable of supporting the first hinge half relative to the second hinge half. A biasing member selectively biases the support into one of the support position and the disengaged position, the support having a first biased position in which the biasing member biases the support into the support position and a second biased position in which the biasing member biases the support into the disengaged position.

In alternative forms of the present disclosure, the support mechanism may further include an actuator moveably connected relative to the hinge, the actuator moveable to actuate the support from a position in which the biasing member biases the support into the disengaged position to another position in which the biasing member biases the support into the support position. In alternative forms of the present disclosure, the actuator may comprise a cam rotatably fixed relative to a pivot to which the support is rotatably fixed and which rotatably supports the support relative to the hinge, so that rotation of the cam about the longitudinal axis of the pivot causes rotation of the support about the longitudinal axis of the pivot, the first hinge half actuating the cam at a cam engagement position of the first hinge half to rotate the cam about the longitudinal axis of the pivot and rotate the support about the longitudinal axis of the pivot into the support position.

In further alternative forms of the present disclosure, the biasing member may comprise a spring having an end pivotally connected to the second hinge half at a first spring pivot axis so that the spring is pivotal relative to the second hinge half about the first spring pivot axis, the spring also having an end pivotally connected to the support at a second spring pivot axis, the second spring pivot axis eccentric to the longitudinal axis of the pivot so that positioning of a first line segment formed between the first spring pivot axis and the second spring pivot axis on a first side of a second line segment formed between the first spring pivot axis and the longitudinal axis of the pivot causes the spring to bias the support toward the support position, the endpoints of the first line segment and the second line segment defining a plane substantially perpendicular to the longitudinal axis of the pivot, and positioning the first line segment on a second side of the second line segment, the second side opposite the first side, causes the spring to bias the support toward the disengaged position.

In exemplary embodiments, the hinge of the present disclosure may be utilized to hingedly connect a hood of a motor vehicle to the vehicle.

BRIEF DESCRIPTION OF THE DRAWINGS

The above-mentioned and other features of the disclosure, and the manner of attaining them, will become more apparent and will be better understood by reference to the following description of an embodiment of the disclosure taken in conjunction with the accompanying drawings, wherein.

Corresponding reference characters indicate corresponding parts throughout the several views. The exemplification set out herein illustrates an embodiment of the disclosure and such exemplification is not to be construed as limiting the scope of the invention in any manner.

DETAILED DESCRIPTION

Figure 1:
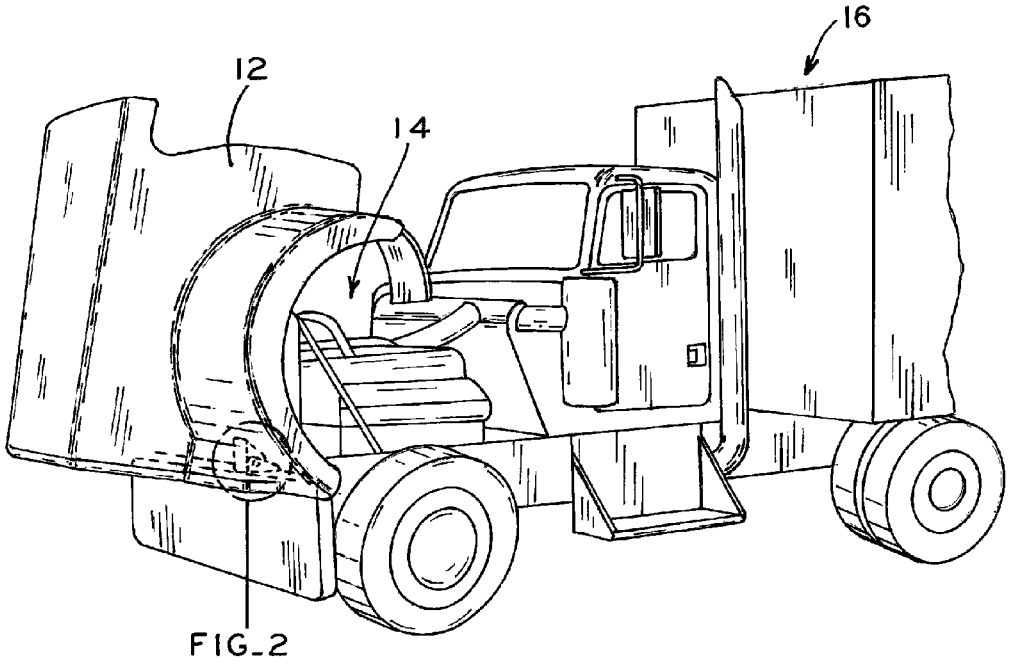
FIG. 1 is a perspective view illustrating a tractor trailer utilizing the hinge of the present disclosure.
Figures 1A, 2A:
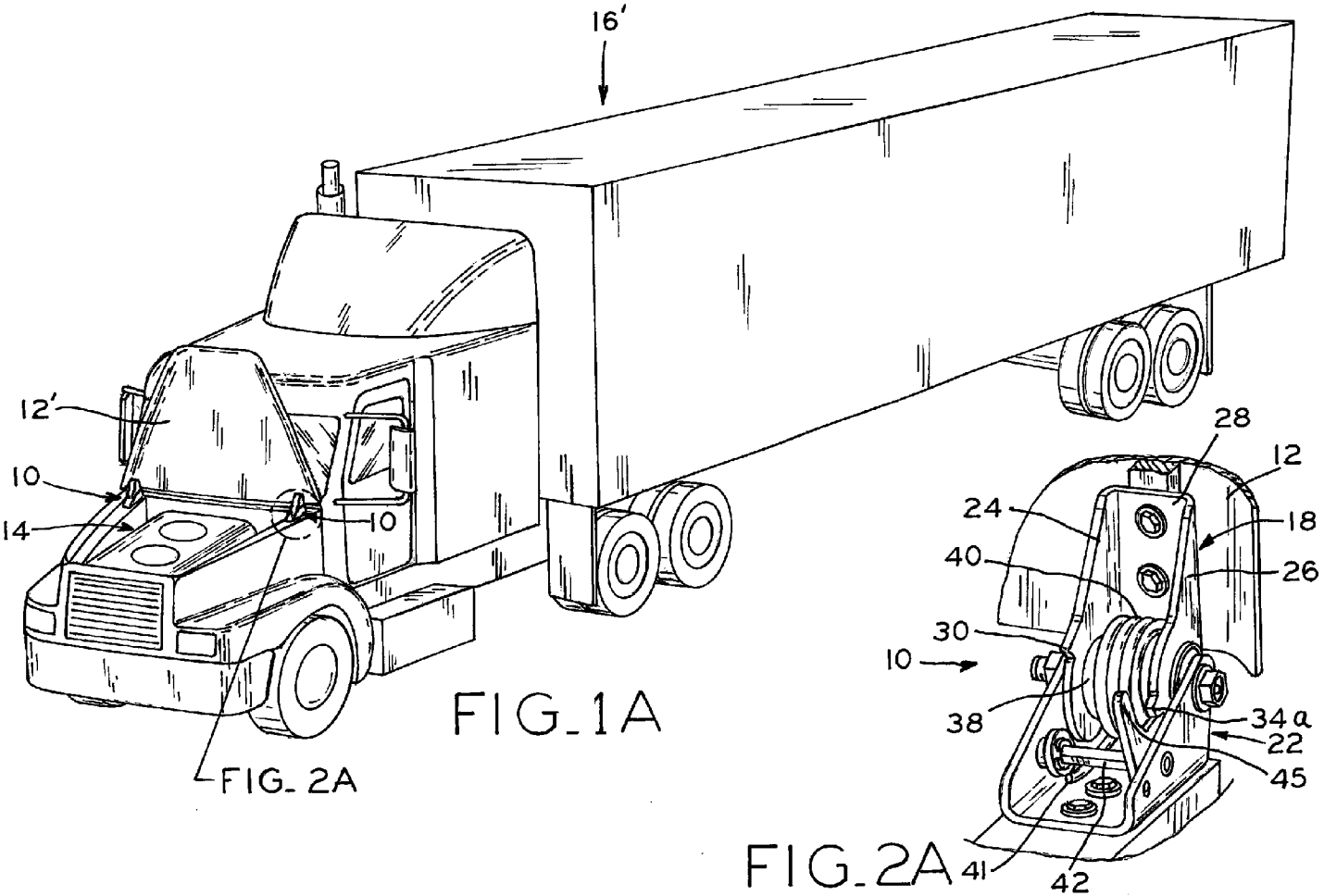
FIG. 1A is a perspective view illustrating an alternative tractor trailer utilizing the hinge of the present disclosure.
FIG. 2A is a detailed view of the hinge illustrated in FIG. 1A.

Referring to FIGS. 1 and 1A, hinge 10 of the present disclosure can be utilized to connect hood 12 to vehicle 16, which may be a tractor trailer for example, so that hood 12 pivots over engine compartment 14. In alternative embodiments, hinge 10 may be utilized to support a hood above alternative motor vehicles such as passenger cars and trucks. Hinge 10 may be utilized to rotatably connect and selectively support any two objects relative to each other. FIG. 1 illustrates a conventional hood structure utilized with a tractor trailer, while FIG. 1A depicts a hood structure more conventionally utilized with a passenger car or truck. While the vehicle, hood and engine compartment illustrated in FIG. 1A are denoted with primed reference numerals, 16', 12' and 14', respectively, the non-primed reference numerals 16, 12 and 14 are used throughout this document to interchangeably refer to the structures illustrated in FIGS. 1 and 1A.

Figure 3:
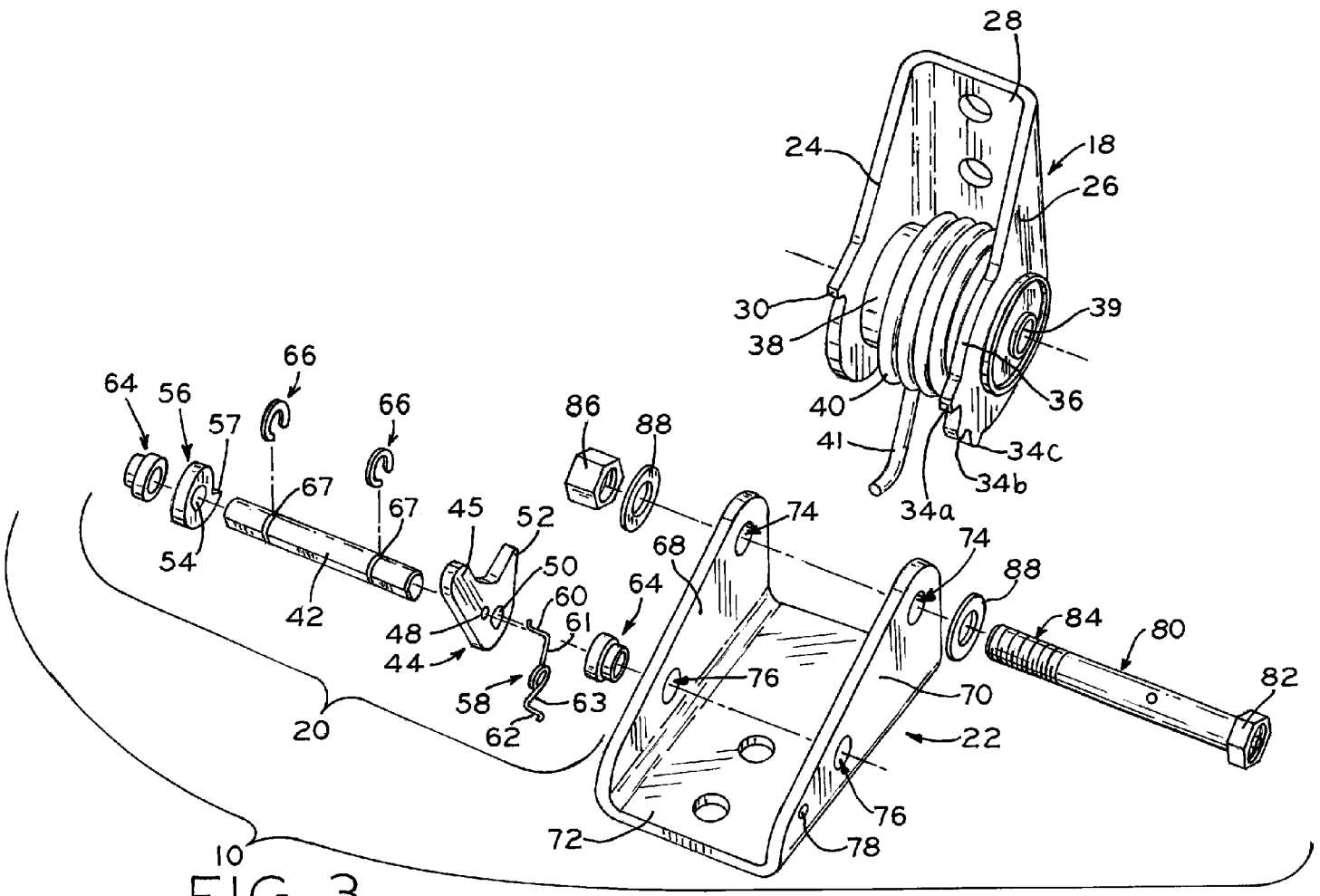
FIG. 3 is a partially exploded view of an exemplary hinge in accordance with the present disclosure.

As described in detail below, hinge 10 is utilized to hingedly support hood 12 relative to vehicle 16 and further to support hood 12 at a number of predefined rotated positions relative to vehicle 16 using support mechanism 20 (FIG. 3). As described in detail below, support mechanism 20 is alternatively biased into one of two positions, a support position and a disengaged position. In the support position, support mechanism 20 is capable of supporting first hinge half 18 relative to second hinge half 22. In the disengaged position, support mechanism 20 is not capable of supporting first hinge half 18 relative to second hinge half 22.

A biasing member, exemplified by torsion spring 58 (see, e.g., FIGS. 3 and 5), selectively biases support mechanism 20 into one of the support position and the disengaged position, as further described below. Further, an automatic reset mechanism is designed to automatically reposition support mechanism 20 from the disengaged position to the support position as hinge 10 approaches a predefined position. In the exemplary embodiment, the predefined position corresponds to a position in which hood 12 is nearly closed.

Figure 2:
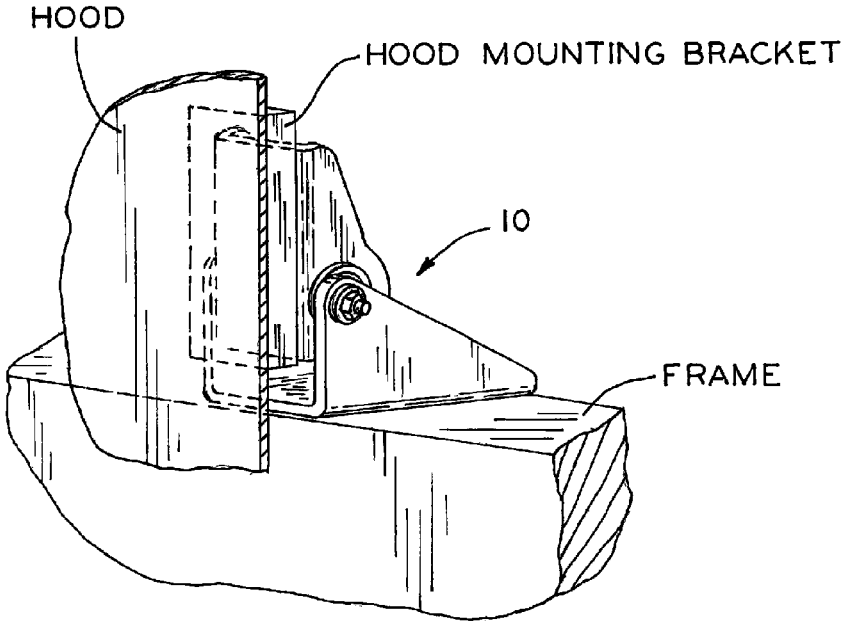
FIG. 2 is a detailed view of the hinge illustrated in FIG. 1.

Referring to FIGS. 2 and 3, hinge 10 includes first hinge half 18 rotatably connected to second hinge half 22. First hinge half 18 includes attachment side 28, left side 24 and right side 26. As illustrated, left side 24 and right side 26 extend from attachment side 28 to form a yoke in which spool 38 is positioned. Spool 38 includes longitudinal aperture 39 extending therethrough. In one exemplary embodiment, spool 38 may be formed as an isolator bushing made of a rubber compound. For example, spool 38 may include an outer diameter formed of a metal skin and an inner diameter formed of a metal skin, with a rubber isolator bushing spanning the metal skins. In such an embodiment, the metal skin of the OD will form a bearing surface for torsion spring 40 and support first hinge half 18, while the metal skin of the ID will form a bearing surface for hinge pin 80 (further described below). The rubber material forming the body of the spool between the aforementioned skins will act to absorb the vibration encountered during travel of a vehicle to which hinge 10 is secured. For example, vibration of hood 12 relative to the vehicle frame will be absorbed by the isolator bushing.

Referring still to FIGS. 2 and 3, second hinge half 22, similar to first hinge half 18, includes attachment side 72, left side 68 and right side 70. As illustrated, left side 68 and right side 70 extend from attachment side 72 of second hinge half 22 to form a yoke. Left side 68 and right side 70 are spaced a sufficient distance to accommodate placement of first hinge half 18 therebetween. Specifically, left side 24 and right side 26 of first hinge half 18 may be positioned between left side 68 and right side 70 of second hinge half 22.

As illustrated in FIG. 3, each of left side 68 and right side 70 of second hinge half 22 includes a hinge pin aperture 74. In construction, first hinge half 18 is positioned within the yoke formed by left side 68 and right side 70 of second hinge half 22, with longitudinal aperture 39 of spool 38 aligned with hinge pin apertures 74. In this position, hinge pin 80 traverses apertures 74 and 39 to rotatably connect first hinge half 18 to second hinge half 22. Apertures 39 and 74 are sized to allow rotational movement about the shaft of hinge pin 80 to allow such relative rotation. As illustrated in FIGS. 2 and 3, hinge pin 80 is secured in place, with nut 86 threadedly secured to threaded distal end 84 of hinge pin 80. In construction, washers 88 are positioned adjacent to head 82 and nut 86, and against right side 70 and left side 68, respectively. As illustrated, hinge pin 80 may comprise a grease bolt having a grease zerk extending from head 82 as illustrated in FIG. 3. In such embodiments, grease bolt 80 may be utilized to provide lubrication to hinge 10.

As illustrated, e.g., in FIG. 3, first hinge half 18 and second hinge half 22 both include apertures extending through attachment sides 28, 72. These apertures are useful for securing hinge 10 to relevant structures such as the frame of vehicle 16 and hood 12. Such securement can be effected utilizing fasteners such as lag bolts (see, e.g., FIG. 2A). Referring to FIG. 2, Lag bolts may be utilized to secure the hood (e.g., via a hood mounting bracket) to the frame of vehicle 16.

Referring to FIGS. 2, 3 and 6-11, torsion spring 40 is coiled about spool 38, with one of arms 41 resting against each of attachment side 28 of first hinge half 18 and attachment side 72 of second hinge half 22. In alternative embodiments, arms 41 of torsion spring 40 may be secured to first hinge half 18 and second hinge half 22. For example, arms 41 may include transverse extensions sized to be pivotally received in corresponding apertures formed in first hinge half 18 and second hinge half 22. For example, a transverse extension from one arm 41 may extend into and be pivotally received by a hole in left side 68 of second hinge half 22, while a transverse extension of the other arm 41 extends into and is pivotally received by a hole in right side 26 of first hinge half 18. In an alternative embodiment, arms 41 may include transverse extensions extending into and pivotally received by holes in right side 70 of second hinge half 22 and left side 24 of first hinge half 18. With arms 41 bearing against first hinge half 18 and second hinge half 22, torsion spring 40 biases first hinge half 18 to rotate relative to second hinge half 22.

Hinge 10 may, in certain exemplary embodiments, be designed such that torsion spring 40 is preloaded so that it provides a biasing force to rotate first hinge half 18 relative to second hinge half 22 throughout the useful range of motion of first hinge half 18 relative to second hinge half 22. For example, torsion spring 40 may be preloaded to bias first hinge half 18 into the open position in which hood 12 provides access to engine compartment 14. The biasing force of a pair of torsion springs (in an embodiment in which two hinges 10 are utilized to hingedly secure hood 12 relative to engine compartment 14) will not be sufficient to support the weight of hood 12 in a rotated position, but will facilitate opening of hood 12 by supporting a portion of the weight thereof. In an embodiment in which hinge 10 is utilized to secure hood 12 to vehicle 16, torsion spring 40 can be preloaded, i.e., it will be elastically deformed, throughout the travel of hood 12 from its closed position to its most open position. In alternative embodiments in which spring 40 is secured to first hinge half 18 and second hinge half 22 (e.g., with transverse extensions pivotally received in corresponding apertures formed in first hinge half 18 and second hinge half 22), spring 40 can be designed to provide a force tending to open first hinge half 18 relative to second hinge half 22 through a particular range of movement and also to provide a force tending to close first hinge half 18 relative to second hinge half 22 through a particular range of movement. For example, spring 40 may be preloaded in tension from the closed position of hood 12 through rotation to a particular point of being "open." At such point, the spring will not be loaded in tension and further opening of the hood will load the spring in compression. With the spring loaded in compression, it will tend to pull the hood into a relatively more closed position.

Designing spring 40 to be able to bias hood 12 alternatively toward an open or a closed position may prove to be particularly useful in installations in with the center of gravity of the hood to which hinge 10 is attached alternates from a position in which the weight of the hood tends to close the hood (e.g., during initial opening of the hood) to a position in which the weight of the hood tends to further open the hood (e.g., toward the end of the range of movement corresponding to the most open position of the hood). If a hood to which hinge 10 is connected can achieve such a position in which the weight of the hood tends to rotate the hood to a more open position, a physical stop may be employed to limit further opening of the hood, in a conventional fashion. In such embodiments, when the weight of the hood is not tending to close the hood, but rather is tending to open the hood, the support system of the present disclosure will not support the weight of the hood at its rotated position, but rather can support first hinge half 18 relative to second hinge half 22 such that the support system will prohibit closing of first hinge half 18 relative to second hinge half 22 (and therefore, prevent closing of hood 12) past a predefined rotated position defined by the support system, as described in detail below.

Support mechanism 20 provides selective support of first hinge half 18 relative to second hinge half 22. Support mechanism 20 includes support 44 featuring pawl 52. Pawl 52 is rotatably connected to second hinge half 22 and cooperates with ratchet teeth 34 of first hinge half 18 to selectively support first hinge half 18 relative to second hinge half 22 as further described below. Support 44 includes keyed aperture 50 having an asymmetrical shape congruent with the cross-sectional profile of pivot 42. Pivot 42 is sized to be received within keyed aperture 50 such that rotation of pivot 42 causes rotation of support 44. Stated another way, support 44 is fixed for rotation with pivot 42. Pivot 42 extends between left side 68 and right side 70 of second hinge half 22 and is rotatably supported relative to second hinge half 22, with a bushing 64 interposed between pivot 42 and each of left side 68 and right side 70 of second hinge half 22. Bushings 64 are positioned within pivot apertures 76 through each of left side 68 and right side 70.

In construction, pivot 42 is passed through bushings 64 which are each positioned within an aperture 76 such that the smaller diameter portion of each bushing 64 is positioned within each aperture 76, with the shoulder formed between the smaller diameter and larger diameter portion of bushing 64 abutting one of left side 68 and right side 70. With bushings 64 positioned through pivot apertures 76, pivot 42 may be passed through bushings 64. Pivot 42, bushings 64 and pivot apertures 76 are sized to permit relative rotation of pivot 42 relative to second hinge half 22. Prior to the passage of pivot 42 through bushings 64, pivot 42 is positioned through keyed aperture 50 of support 44 and keyed aperture 54 of cam 56. With pivot 42 positioned through bushings 64, cam 56 and support 44, snap rings 66 may be positioned in grooves 67 of pivot 42 to axially fix the position of the components of support mechanism 20, with bushings 64 and snap rings 66 cooperating to align cam 56 and support 44 with the cooperating structures (reset projection 30 and ratchet teeth 34) of first hinge half 18. The cooperating structures of first hinge half 18 and second hinge half 22 could be reversed from the positions illustrated so that the support mechanism would be located adjacent to left side 68 as opposed to right side 70 as illustrated in the Figs of the present application. A hinge constructed in this fashion would be a mirror image of the hinge depicted in the exemplification illustrated in the Figs. of the present application.

With support mechanism 20 pivotally connected to second hinge half 22, support 44 is rotatable between a support position in which pawl 52 is engageable with ratchet teeth 34 to support first hinge half 18 at a rotated position relative to second hinge half 22 and a disengaged position in which pawl 52 is not engageable with ratchet teeth 34 and first hinge half 18 is freely rotatable relative to second hinge half 22. Support mechanism 20 includes a biasing member or biasing means operable to selectively bias support 44 into one of the support position and the disengaged position. In the exemplary embodiment illustrated herein, the biasing member or biasing means takes the form of torsion spring 58.

Figure 4:
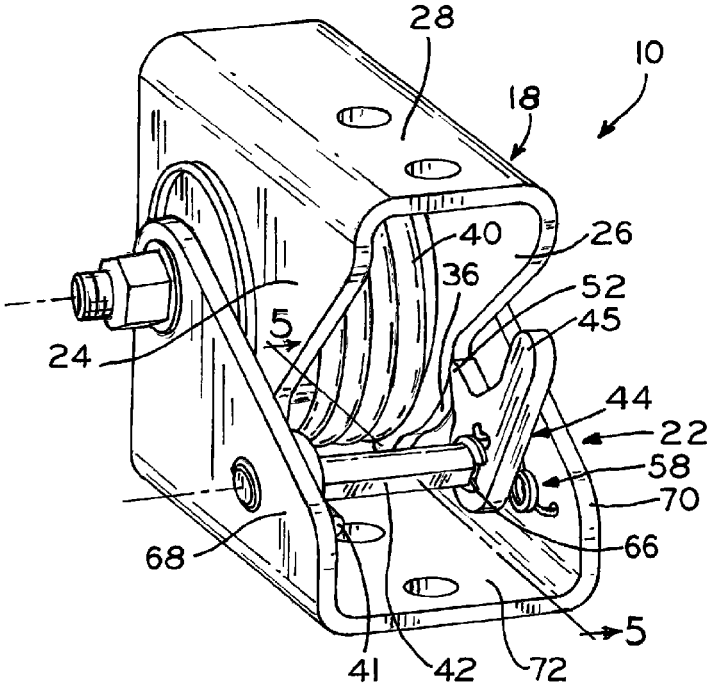
FIG. 4 is a perspective view of the hinge illustrated in FIG. 3 shown in a closed position.
Figure 5:
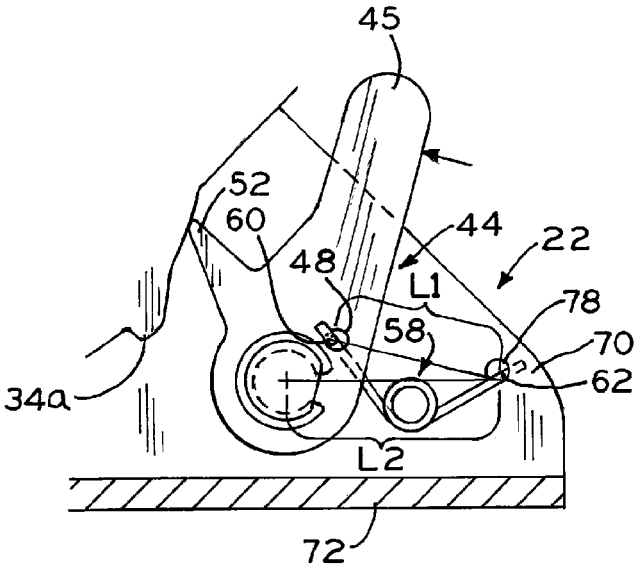
FIG. 5 is a fragmented, detailed view of a support operable to support a first hinge half relative to a second hinge half at select rotated positions.

Torsion spring 58 includes arms 61, 63 extending therefrom. At the distal end of each arm 61, 63 is a respective extension 60, 62. Referring to FIGS. 3-5, first extension 60 is positioned through spring aperture 48 of support 44, while second extension 62 is positioned through spring aperture 78 of right side 70 of second hinge half 22 to pivotally connect torsion spring 58 to both support 44 and second hinge half 22. Specifically, torsion spring 58 is pivotally connected about spring pivot axes defined by the longitudinal axes of extensions 60, 62. With torsion spring 58 secured to support 44 and right side 70 of second hinge half 22, torsion spring 58 is preloaded, i.e., torsion spring 58 is actuated from its at rest position to a contracted position in which the helical coil of torsion spring 58 is elastically deformed and biases arms 61, 63 to rotate away from each other. While the biasing member or biasing means utilized to selectively bias support 44 into one of the support position and the disengaged position is exemplified in the drawings as torsion spring 58, any resiliently compressible member that will provide an expansive reaction force may be utilized. For example, a preloaded compression spring may be utilized in lieu of torsion spring 58.

The longitudinal axes of extensions 60, 62 each define a pivot axis for articulation of torsion spring 58. Referring to FIG. 5, line segment $L_1$ is defined between the longitudinal axis of first extension 60 and the longitudinal axis of second extension 62. Similarly, line segment $L_2$ is defined between the longitudinal axis of second extension 62 and the longitudinal axis of pivot 42. The endpoints of line segment $L_1$ and line segment $L_2$ define a plane substantially perpendicular to the pivot axis of pivot 42. "Substantially perpendicular" means geometrically perpendicular or within a few (about 5) degrees of perpendicular. The longitudinal axis of first extension 60 and the longitudinal axis of pivot 42 are eccentric, i.e., they do not share the same center. As support 44 is rotated about the longitudinal axis of pivot 42, line segment $L_1$ moves relative to line segment $L_2$, which is substantially fixed in position. With line segment $L_1$ positioned on a first side of line segment $L_2$, above line segment $L_2$ as illustrated in FIG. 5, torsion spring 58 biases support 44 into counterclockwise rotation with reference to the perspective of FIG. 5. Stated another way, with line segment $L_1$ positioned above line segment $L_2$, as illustrated in FIG. 5, support 44 is biased by torsion spring 58 into rotation about the longitudinal axis of pivot 42 which brings pawl 52 into engagement with first hinge half 18. If support 44 is rotated such that line segment $L_1$ is positioned on a second side of line segment $L_2$ opposite the first side of line segment $L_2$ mentioned above (as illustrated in FIG. 11, below line segment $L_2$), then torsion spring 58 biases support 44 into clockwise rotation with reference to the perspective of FIG. 11. Stated another way, positioning of line segment $L_1$ below line segment $L_2$ biases support 44 into a rotational position in which pawl 52 is disengaged with first hinge half 18 and support 44 abuts attachment side 72 of second hinge half 22. The position exemplified in FIG. 5, with line segment $L_1$ positioned above line segment $L_2$, corresponds to the support position referenced in this document. Similarly, the position exemplified in FIG. 11, with line segment $L_1$ positioned below line segment $L_2$, corresponds to the disengaged position referenced in this document. The positioning described above works to orient the reaction force vector resulting from the preloading of torsion spring 58 to act on support 44 to bias support 44 into one of the support and disengaged positions depending on whether the aforementioned force vector is "over" or "under" center with respect to the pivot axis of support 44, i.e., the longitudinal axis of pivot 42.

When used in connection with vehicle 16, it is desirable for support 44 to be biased into the support position illustrated in FIG. 5 when the hood is closed so that upon opening of the hood pawl 52 will ride along ratchet teeth 34 to automatically support hood 12 above engine compartment 14, as pawl 52 passes each ratchet tooth 34*a*, 34*b*, 34*c*. If passage of pawl 52 over a ratchet tooth 34 positions the center of gravity of the hood such that the weight of the hood tends to further open the hood, then pawl 52 and the ratchet tooth 34 in question do not support the weight of the hood but rather support the hood against further closure past a predefined point of rotation defined by the interaction of pawl 52 and the ratchet tooth in question. When closure of hood 12 is desired, movement of support 44 into the disengaged position illustrated in FIG. 11 allows free movement of first hinge half 18 relative to second hinge half 22 to allow for closure of hood 12 above engine compartment 14. As described above, when support 44 maintains the disengaged position illustrated in FIG. 11, torsion spring 58 biases support 44 such that pawl 52 is not engageable with ratchet teeth 34. The hinge of the present disclosure advantageously provides an automatic reset which actuates support 44 from the disengaged position illustrated in FIG. 11 to the support position illustrated in FIG. 5 as hood 12 approaches a closed position atop engine compartment 14.

Figure 11:
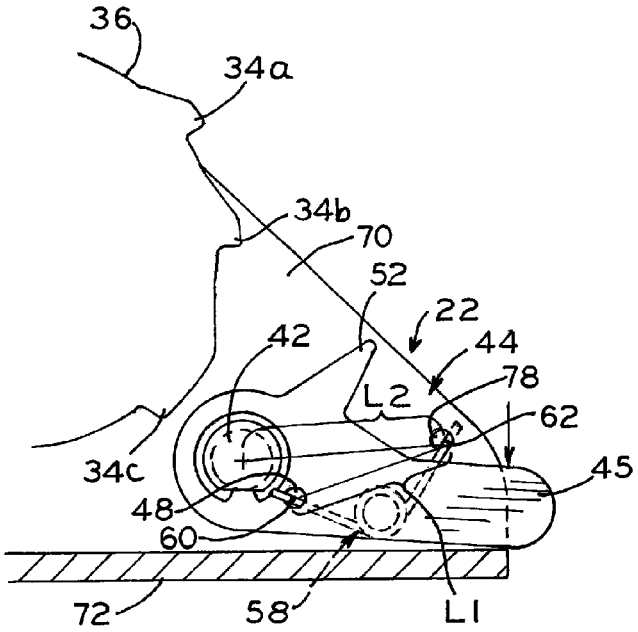
FIG. 11 is a fragmented, elevational view, illustrating the support biased into the disengaged position illustrated in FIG. 10.
Figure 12:
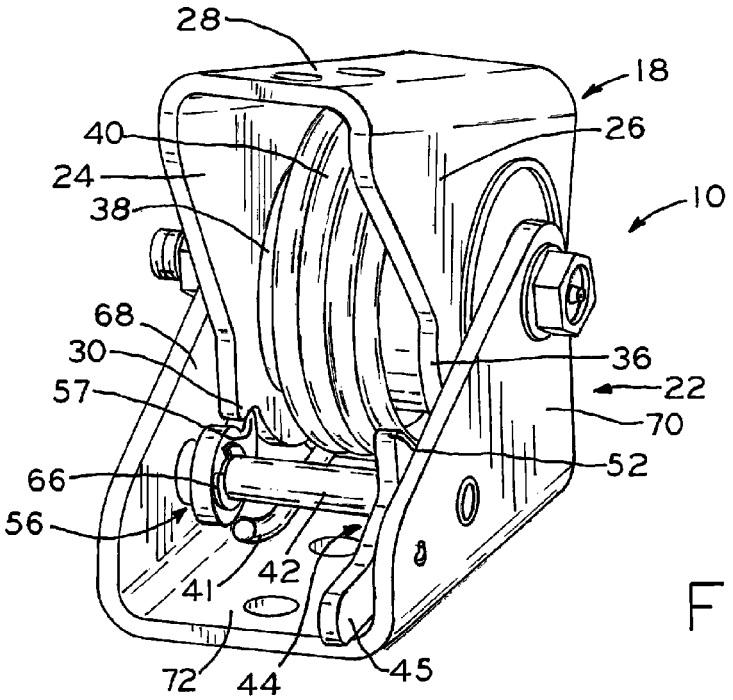
FIG. 12 is a perspective view illustrating automatic actuation of the support from the disengaged position to the support position, as the first hinge half and second hinge half approach a closed position.
Figure 13:
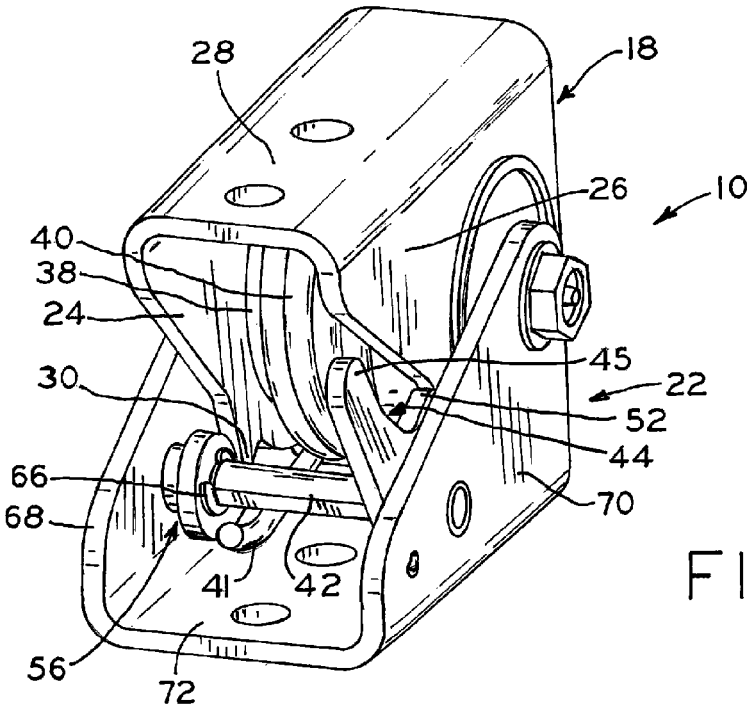
FIGS. 13-14 are alternative, perspective views illustrating the hinge halves of an exemplary embodiment of the hinge of the present disclosure in a closed position, with the support biased into the support position.
Figure 14:
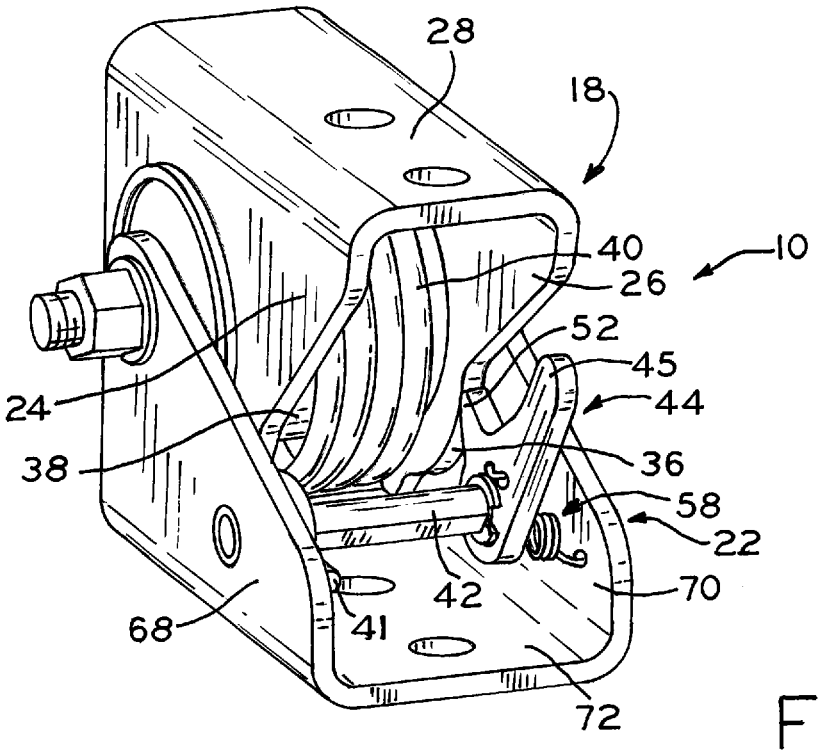

Referring to FIG. 3, cam 56 is rotatably secured to pivot 42 via cooperation of keyed aperture 54 with the cross-sectional profile of pivot 42. Specifically, pivot 42 is sized to be received within keyed aperture 54 of cam 56 such that rotation of pivot 42 causes rotation of cam 56 and vice versa. Stated another way, pivot 42 is fixed for rotation with cam 56. As illustrated in FIG. 12, first hinge half 18 includes reset projection 30 extending from left side 24 thereof. As illustrated in FIG. 12, reset projection 30 contacts cam surface 57 when support 44 is in the disengaged position and hinge 10 approaches a closed condition. In an exemplary embodiment, reset projection 30 contacts cam surface 57 as illustrated in FIG. 12 when hood 12 is rotated from an open position to a position approximately 10° from its final, closed position. The remainder of travel of hood 12 to the closed position causes reset projection 30 to rotate cam 56 and, therefore, pivot 42 and support 44. Specifically, closure of hinge 10 from the position illustrated in FIG. 12 to the position illustrated in FIG. 13 rotates support mechanism 20 until line segment $L_1$ (see FIGS. 5 and 11) is moved from a position beneath line segment $L_2$ as illustrated in FIG. 11 to a position in which it is above line segment $L_2$ as illustrated in FIG. 5. Therefore, the automatic reset mechanism or reset means comprised of reset projection 30 and cam 56 cooperates with and forms a part of support mechanism 20 to automatically reposition support 44 from the disengaged position (see, e.g., FIGS. 11 and 12) to the support position (see, e.g., FIGS. 5 and 13) as hood 12 and, consequently, hinge 10 approaches a closed position. Specifically, cam 56 comprises an actuator moveable to actuate torsion spring 58 into position to bias support 44 into the support position.

FIGS. 4, 6-10, 12 and 13 sequentially illustrate actuation of hinge 10 from an initially closed position to different open positions and back to a closed position. Referring to FIG. 4, hinge 10 is shown in a closed position corresponding to hood 12 closing engine compartment 14 (FIGS. 1, 1A). With hinge 10 in the closed position, support 44 maintains the support position, as described above. Specifically, support 44 is biased into the support position by torsion spring 58. As hood 12 is opened, first hinge half 18 is rotated relative to second hinge half 22 from the position illustrated in FIG. 4 to the position illustrated in FIG. 6. With support 44 biased into the support position, pawl 52 rides along support contact surface 36 until encountering first ratchet tooth 34*a*. As pawl 52 rides over first ratchet tooth 34*a*, support 44 will be slightly rotated from the position illustrated in FIG. 5 toward, but not reaching the position illustrated in FIG. 11. Specifically, first ratchet tooth 34 and pawl 52 are sized such that the rotation of support 44 caused by pawl 52 riding over first ratchet tooth 34*a* will cause line segment $L_1$ illustrated in FIG. 5 to more closely approach line segment $L_2$ than the position illustrated in FIG. 5, but not to dip beneath line segment $L_2$, which would cause support 44 to be biased into the disengaged position.

Figure 6:
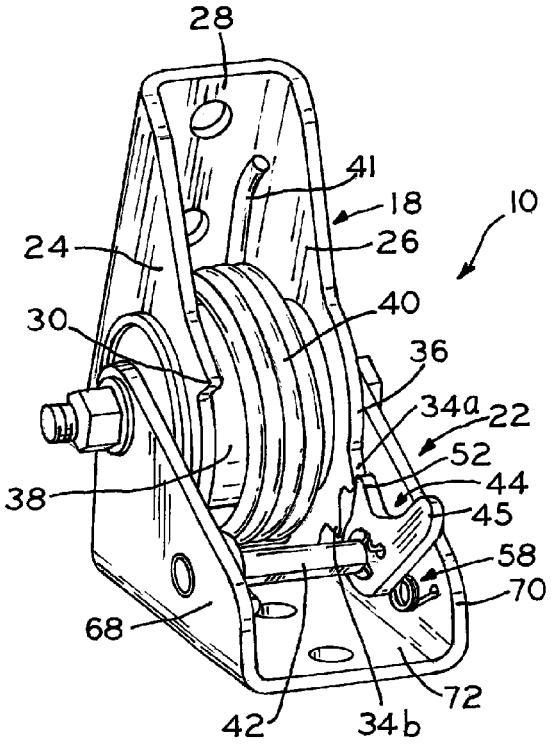
FIG. 6 is a perspective view illustrating the support biased into a support position in which said support is capable of supporting a first hinge half at a select rotated position relative to a second hinge half.
Figure 7:
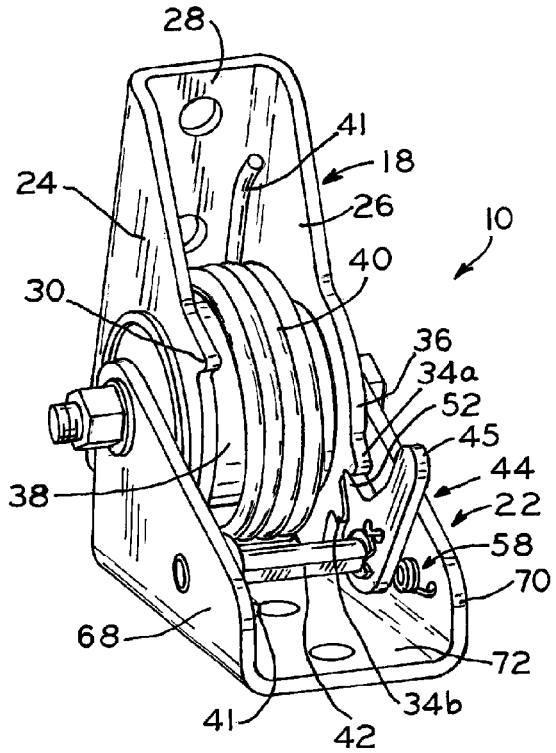
FIG. 7 is a further perspective view of the hinge illustrated in FIG. 6, showing the support positioned to support the first hinge half at a select rotated position relative to the second hinge half.

Referring to FIGS. 6 and 7, as hinge 10 is further rotated from the closed position illustrated in FIG. 4 to progressively more open positions, pawl 52 will ride over first ratchet tooth 34*a* until reaching a position intermediate first ratchet tooth 34*a* and second ratchet tooth 34*b* as illustrated in FIG. 7. In the position illustrated in FIG. 7, support 44 is capable of supporting first hinge half 18 at the rotated position illustrated in FIG. 7 relative to second hinge half 22 (or a position closely approximately the position illustrated in FIG. 7, based on the operational principals of the ratchet and pawl mechanism, which is described in more detail below). Specifically, the interaction of pawl 52 with first tooth 34*a* prevents first hinge half 18 from being rotated towards the closed position illustrated in FIG. 4.

Support 44, including pawl 52 and ratchet teeth 34 may be sized and oriented so that, with pawl 52 positioned below a ratchet tooth 34, any force seeking to rotate first hinge half 18 toward a relatively more closed position will be received by support 44 in such a way that it will not cause support 44 to rotate about the longitudinal axis of pivot 42. For example, the support structure may be sized and oriented so that, with pawl positioned below a ratchet tooth 34, any force seeking to rotate first hinge half 18 toward a relatively more closed position will define a force vector applied to support 44 that intersects or is closely proximate enough to the longitudinal axis (i.e., the rotational axis) of pivot 42 that such force vector will not cause rotation of support 44 about the longitudinal axis of pivot 42. Further, ratchet teeth 34 may have a geometry such that with one ratchet tooth 34 positioned atop pawl 52 and another ratchet tooth 34 position below pawl 52, the ratchet tooth 34 positioned below pawl 52 will present a physical barrier to rotation of pawl 52 in a direction associated with closing of the hinge. Additionally, a discrete positive stop feature that limits rotation of support 44 toward first hinge half 18 may be incorporated. For example, a boss extending from right side 70 of second hinge half 22 may be positioned to present a physical barrier to rotation of support 44 toward first hinge half 18 when pawl 52 is operably positioned with one of ratchet teeth 34 resting atop pawl 52. Further, embodiments of the present disclosure may function such that, with a ratchet tooth 34 positioned atop pawl 52, such ratchet tooth will (as influenced, e.g., by the weight of hood 12) rotate pawl 52 and, consequently, support 44 until handle 45 of support 44 abuts right side 26 of first hinge half 18 (e.g., support contact surface 36 or another ratchet tooth 34) to prohibit further rotation of support 44 and thereby support first hinge half 18 at a rotated position relative to second hinge half 22. In further alternative embodiments, when pawl 52 is positioned below a ratchet tooth 34 and a load directed to move first hinge half 22 toward a relatively more closed position (e.g., gravity) is applied to first hinge half 18, the radially extending portion of cam 56 on which cam surface 57 is located is sized and positioned such that it will abut attachment side 72 of second hinge half 22 and thereby prevent rotation of pivot 42, support 44 and, consequently, first hinge half 18 toward the relatively more closed position. Any of these rotation preventing structures alone or in combination with others of these rotation preventing structures may be utilized to allow support 44 to support first hinge half 18 at a rotated position relative to second hinge half 22.

Figure 8:
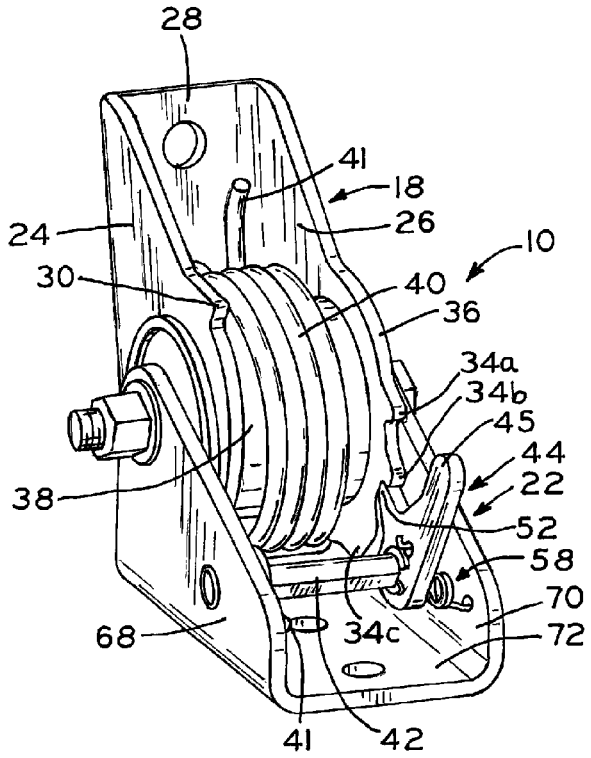
FIG. 8 is another perspective view illustrating the support positioned to support the first hinge half relative to the second hinge half at a second select rotated position.

FIG. 8 illustrates hinge 10 in a position further rotated from the position illustrated in FIG. 7. To move from the position illustrated in FIG. 7 to the position illustrated in FIG. 8, pawl 52 rides over ratchet tooth 34*b* in the same way as it traveled over ratchet tooth 34*a*. Additional ratchet teeth 34 may be provided if it is desired to provide additional support positions for first hinge half 18 relative to second hinge half 22.

Figure 9:
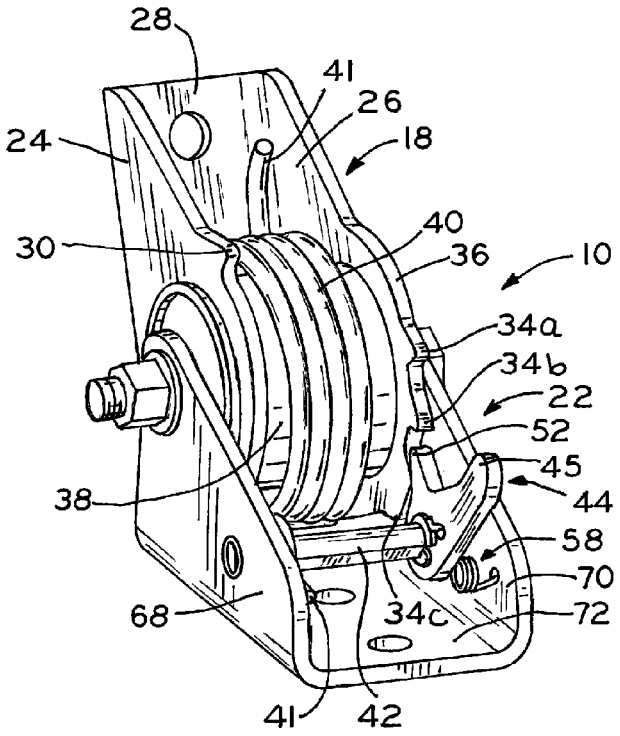
FIG. 9 is a perspective view illustrating the hinge of FIG. 8 rotated to a more open position relative to the position of FIG. 8.
Figure 10:
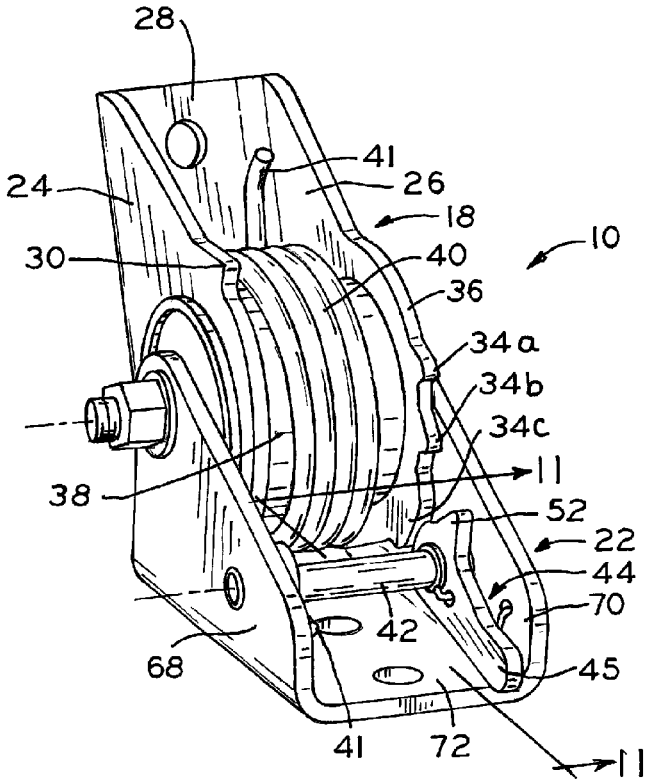
FIG. 10 is a perspective view of the hinge of the present disclosure, with the support biased into a disengaged position in which the support is not capable of supporting the first hinge half relative to the second hinge half.

FIG. 9 illustrates movement of hinge 10 to a position in which pawl 52 can be disengaged from ratchet teeth 34. Specifically, FIG. 9 represents a position in which first hinge half 18 is rotated relative to second hinge half 22 to a position slightly more open than the support position presented by the interaction of a ratchet tooth 34 and pawl 52. In this position, handle 45 can be actuated to rotate support 44 from the position illustrated in FIG. 9 to the position illustrated in FIG. 10. By rotating first hinge half 18 from the position illustrated in FIG. 8 to the position illustrated in FIG. 9, ratchet tooth 34*b* is moved out of position to present a physical barrier to rotation of support 44 from the position illustrated in FIG. 9 to the position illustrated in FIG. 10. With support 44 rotated into the position illustrated in FIG. 10, line segment $L_1$ attains the position illustrated in FIG. 11 and torsion spring 58 biases support 44 into the disengaged position. In this position, hood 12 can be freely rotated from an open position to the closed position, with such rotation over the last 10° of travel actuating the automatic reset mechanism as described above.

While this disclosure has been described as having exemplary designs, the present disclosure can be further modified within the spirit and scope of this disclosure. This application is therefore intended to cover any variations, uses, or adaptations of the disclosure using its general principles. Further, this application is intended to cover such departures from the present disclosure as come within known or customary practice in the art to which this disclosure pertains and which fall within the limits of the appended claims.

What is claimed is:

1. A hinge mechanism, comprising:

a hinge comprising:

a first hinge half;

a second hinge half rotatably connected to said first hinge half, whereby said first hinge half is rotatable about a hinge axis relative to said second hinge half;

a support mechanism, comprising:

a support moveable from a support position in which said support is capable of supporting said first hinge half at a first rotated position relative to said second hinge half and a disengaged position in which said support is not capable of supporting said first hinge half relative to said second hinge half; and a biasing member selectively biasing said support into one of said support position and said disengaged position, said support having a first biased position in which said biasing member biases said support into said support position and a second biased position in which said biasing member biases said support into said disengaged position.

2. The hinge mechanism in claim 1, wherein said support mechanism comprises an actuator moveably connected relative to said hinge, said actuator moveable to actuate said support from said second biased position in which said biasing member biases said support into said disengaged position to said first biased position in which said biasing member biases said support into said support position.

3. The hinge mechanism of claim 2, wherein said hinge further comprises:

a pivot defining a longitudinal axis, said pivot rotatably connected to said hinge, said support rotatably supported relative to said hinge by said pivot, said support rotatably fixed relative to said pivot for rotation therewith.

4. The hinge mechanism of claim 3, wherein said actuator comprises a cam rotatably fixed relative to said pivot for rotation therewith, whereby rotation of said cam about said longitudinal axis of said pivot causes rotation of said support about said longitudinal axis of said pivot, said first hinge half actuating said cam at a cam engagement position of said first hinge half to rotate said cam about said longitudinal axis of said pivot and rotate said support about said longitudinal axis of said pivot into said support position.

5. The hinge mechanism of claim 1, further comprising:

a hinge pin rotatably connecting said first hinge half to said second hinge half; and a torsion spring surrounding said hinge pin and operable to bias said first hinge half into an open position relative to said second hinge half.

6. The hinge mechanism of claim 3, wherein said biasing member comprises a spring, said spring having an end pivotally connected to said second hinge half at a first spring pivot axis so that said spring is pivotal relative to said second hinge half about said first spring pivot axis, said spring also having an end pivotally connected to said support at a second spring pivot axis, said second spring pivot axis eccentric to said longitudinal axis of said pivot, so that positioning of a first line segment formed between said first spring pivot axis and said second spring pivot axis on a first side of a second line segment formed between said first spring pivot axis and said longitudinal axis of said pivot causes said spring to bias said support toward said support position, the endpoints of the first line segment and the second line segment defining a plane substantially perpendicular to the longitudinal axis of the pivot, and positioning the first line segment on a second side of the second line segment, the second side opposite the first side, causes said spring to bias said support toward said disengaged position.

7. The hinge mechanism of claim 6, wherein said spring comprises a helical spring coil.

8. The hinge mechanism of claim 1, wherein said support comprises a pawl and wherein said first hinge half comprises a plurality of ratchet teeth, said plurality of ratchet teeth sized and shaped to cooperate with said pawl, whereby said pawl is capable of abutting one of said plurality of ratchet teeth to support said first hinge half relative to said second hinge half when said support is in said support position.

9. A vehicle comprising:

an engine compartment;

a hood sized to cover said engine compartment;

a hinge comprising:

a first hinge half;

a second hinge half rotatably connected to said first hinge half, whereby said first hinge half is rotatable about a hinge axis relative to said second hinge half;

a support mechanism, comprising:

a support moveable from a support position in which said support is capable of supporting said first hinge half at a first rotated position relative to said second hinge half and a disengaged position in which said support is not capable of supporting said first hinge half relative to said second hinge half; and a biasing member selectively biasing said support into one of said support position and said disengaged position, said support having a first biased position in which said biasing member biases said support into said support position and a second biased position in which biasing member biases said support into said disengaged position.

10. The vehicle in claim 9, wherein said support mechanism comprises an actuator moveably connected relative to said hinge, said actuator moveable to actuate support from said second biased position in which said biasing member biases said support into said disengaged position to said first biased position in which said biasing member biases said support into said support position.

11. The vehicle of claim 10, wherein said hinge further comprises:

a pivot defining a longitudinal axis, said pivot rotatably connected to said hinge, said support rotatably supported relative to said hinge by said pivot, said support rotatably fixed relative to said pivot for rotation therewith.

12. The vehicle of claim 11, wherein said actuator comprises a cam rotatably fixed relative to said pivot for rotation therewith, whereby rotation of said cam about said longitudinal axis of said pivot causes rotation of said support about said longitudinal axis of said pivot, said first hinge half actuating said cam at a cam engagement position of said first hinge half to rotate said cam about said longitudinal axis of said pivot and rotate said support about said longitudinal axis of said pivot into said support position.

13. The vehicle of claim 9, further comprising:

a hinge pin rotatably connecting said first hinge half to said second hinge half; and a torsion spring surrounding said hinge pin and operable to bias said first hinge half into an open position relative to said second hinge half.

14. The vehicle of claim 11, wherein said biasing member comprises a spring, said spring having an end pivotally connected to said second hinge half at a first spring pivot axis so that said spring is pivotal relative to said second hinge half about said first spring pivot axis, said spring also having an end pivotally connected to said support at a second spring pivot axis, said second spring pivot axis eccentric to said longitudinal axis of said pivot, so that positioning of a first line segment formed between said first spring pivot axis and said second spring pivot axis on a first side of a second line segment formed between said first spring pivot axis and said longitudinal axis of said pivot causes said spring to bias said support toward said support position, the endpoints of the first line segment and the second line segment defining a plane substantially perpendicular to the longitudinal axis of the pivot, and positioning the first line segment on a second side of the second line segment, the second side opposite the first side, causes said spring to bias said support toward said disengaged position.

15. The vehicle of claim 14, wherein said spring comprises a torsion spring.

16. The vehicle of claim 10, wherein said support comprises a pawl and wherein said first hinge half comprises a plurality of ratchet teeth, said plurality of ratchet teeth sized and shaped to cooperate with said pawl, whereby said pawl is capable of abutting one of said plurality of ratchet teeth to support said first hinge half relative to said second hinge half when said support is in said support position.

17. A hinge mechanism, comprising:

a hinge comprising:

a first hinge half; and a second hinge half rotatably connected to said first hinge half, whereby said first hinge half is rotatable about a hinge axis relative to said second hinge half;

a support mechanism, comprising:

a support moveable from a support position in which said support is capable of supporting said first hinge half at a first rotated position relative to said second hinge half and a disengaged position in which said support is not capable of supporting said first hinge half relative to said second hinge half; and a biasing means for biasing said support into said support position in one instance and for biasing said support into said disengaged position in another instance.

18. The hinge mechanism in claim 17, wherein said support mechanism comprises a reset means for resetting said support from said disengaged position to said support position.

19. The hinge mechanism of claim 18, wherein said hinge further comprises:

a pivot defining a longitudinal axis, said pivot rotatably connected to said hinge, said support rotatably supported relative to said hinge by said pivot, said support rotatably fixed relative to said pivot for rotation therewith.

20. The hinge mechanism of claim 19, wherein said reset means comprises a cam rotatably fixed relative to said pivot for rotation therewith, whereby rotation of said cam about said longitudinal axis of said pivot causes rotation of said support about said longitudinal axis of said pivot, said first hinge half actuating said cam at a cam engagement position of said first hinge half to rotate said cam about said longitudinal axis of said pivot and rotate said support about said longitudinal axis of said pivot into said support position.

21. The hinge mechanism of claim 17, further comprising:

a hinge pin rotatably connecting said first hinge half to said second hinge half; and a torsion spring surrounding said hinge pin and operable to bias said first hinge half into an open position relative to said second hinge half.

22. The hinge mechanism of claim 19, wherein said biasing means comprises a spring, said spring having an end pivotally connected to said second hinge half at a first spring pivot axis so that said spring is pivotal relative to said second hinge half about said first spring pivot axis, said spring also having an end pivotally connected to said support at a second spring pivot axis, said second spring pivot axis eccentric to said longitudinal axis of said pivot, so that positioning of a first line segment formed between said first spring pivot axis and said second spring pivot axis on a first side of a second line segment formed between said first spring pivot axis and said longitudinal axis of said pivot causes said spring to bias said support toward said support position, the endpoints of the first line segment and the second line segment defining a plane substantially perpendicular to the longitudinal axis of the pivot, and positioning the first line segment on a second side of the second line segment, the second side opposite the first side, causes said spring to bias said support toward said disengaged position.

23. The hinge mechanism of claim 22, wherein said spring comprises a helical spring coil.

24. The hinge mechanism of claim 1, wherein said support comprises a pawl and wherein said first hinge half comprises a plurality of ratchet teeth, said plurality of ratchet teeth sized and shaped to cooperate with said pawl, whereby said pawl is capable of abutting one of said plurality of ratchet teeth to support said first hinge half relative to said second hinge half when said support is in said support position.

* * * * *